US011715481B2

(12) United States Patent
Liang

(10) Patent No.: US 11,715,481 B2
(45) Date of Patent: Aug. 1, 2023

(54) ENCODING PARAMETER ADJUSTMENT METHOD AND APPARATUS, DEVICE, AND STORAGE MEDIUM

(71) Applicant: Tencent Technology (Shenzhen) Company Limited, Shenzhen (CN)

(72) Inventor: Junbin Liang, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 150 days.

(21) Appl. No.: 17/368,609

(22) Filed: Jul. 6, 2021

(65) Prior Publication Data

US 2021/0335378 A1 Oct. 28, 2021

Related U.S. Application Data

(63) Continuation of application No. PCT/CN2020/098396, filed on Jun. 28, 2020.

(30) Foreign Application Priority Data

Jul. 25, 2019 (CN) ..... 201910677220.0

(51) Int. Cl.
*G10L 21/0232* (2013.01)
*G10L 19/008* (2013.01)
(Continued)

(52) U.S. Cl.
CPC ..... *G10L 21/0232* (2013.01); *G10L 19/008* (2013.01); *G10L 25/84* (2013.01);
(Continued)

(58) Field of Classification Search
CPC ... G10L 21/0232; G10L 19/02; G10L 19/008; G10L 19/002; G10L 19/032; G10L 19/24;
(Continued)

(56) References Cited

U.S. PATENT DOCUMENTS

2002/0116179 A1* 8/2002 Watanabe ..... G10L 19/02 704/E19.01
2011/0075855 A1* 3/2011 Oh ..... G10L 19/032 704/226
2016/0104487 A1* 4/2016 Schnabel ..... G10L 19/09 704/219

FOREIGN PATENT DOCUMENTS

CN 1461112 A 12/2003
CN 101223576 A 7/2008
(Continued)

OTHER PUBLICATIONS

Tencent Technology, ISR, PCT/CN2020/098396, dated Oct. 10, 2020, 2 pgs.

(Continued)

*Primary Examiner* — Leshui Zhang
(74) *Attorney, Agent, or Firm* — Morgan, Lewis & Bockius LLP

(57) ABSTRACT

An encoding parameter adjustment method is performed at a computer device. The method includes: obtaining a first audio signal, and determining a psychoacoustic masking threshold within a service frequency band in the first audio signal; obtaining a second audio signal, and determining a background environmental noise estimation value of the frequency within the service frequency band in the second audio signal; determining a masking tag corresponding to the service frequency band according to the psychoacoustic masking threshold of the first audio signal and the background environmental noise estimation value of the second audio signal; determining a masking rate of the service frequency band according to the masking tag corresponding to the frequency within the service frequency band; determining a first reference bit rate according to the masking rate of the service frequency band; and configuring an encoding
(Continued)

bit rate of an audio encoder based on the first reference bit rate.

20 Claims, 6 Drawing Sheets

(51) Int. Cl.
*G10L 25/84* (2013.01)
*G10L 21/0208* (2013.01)
*G10L 25/18* (2013.01)
*G10L 21/0216* (2013.01)

(52) U.S. Cl.
CPC ..... *G10L 2021/02087* (2013.01); *G10L 2021/02163* (2013.01)

(58) Field of Classification Search
CPC ... G10L 19/012; G10L 19/16; G10L 19/0204; G10L 19/06; G10L 19/04; G10L 19/26; G10L 19/0208; G10L 19/00; G10L 19/08; G10L 19/018; G10L 25/84; G10L 25/18; G10L 2021/02087; G10L 2021/02163; H04B 1/665
USPC ..... 704/226, 227, 228, 229, 230, 225, 219, 704/215, 214, 210, 208, 206, 205, 704/500–504; 381/1–23
See application file for complete search history.

(56) References Cited

FOREIGN PATENT DOCUMENTS

| | | | | |
|---|---|---|---|---|
| CN | 101989423 | A | | 3/2011 |
| CN | 104837042 | A | * | 8/2015 |
| CN | 104837042 | A | | 8/2015 |
| CN | 110265046 | A | | 9/2019 |
| EP | 0661821 | A1 | | 7/1995 |

OTHER PUBLICATIONS

Tencent Technology, WO, PCT/CN2020/098396, dated Oct. 10, 2020, 5 pgs.
Tencent Technology, IPRP, PCT/CN2020/098396, dated Jan. 25, 2020, 6 pgs.

* cited by examiner

ENCODING PARAMETER ADJUSTMENT METHOD AND APPARATUS, DEVICE, AND STORAGE MEDIUM

CROSS-REFERENCE TO RELATED APPLICATIONS

This application is a continuation application of PCT Patent Application No. PCT/CN2020/098396, entitled "ENCODING PARAMETER ADJUSTMENT METHOD AND APPARATUS, DEVICE, AND STORAGE MEDIUM" filed on Jun. 28, 2020, which claims priority to Chinese Patent Application No. 201910677220.0, filed with the State Intellectual Property Office of the People's Republic of China on Jul. 25, 2019, and entitled "ENCODING PARAMETER ADJUSTMENT METHOD AND APPARATUS, DEVICE, AND STORAGE MEDIUM", all of which are incorporated herein by reference in their entirety.

FIELD OF THE TECHNOLOGY

This application relates to the field of audio encoding technologies, and in particular, to an encoding parameter adjustment technology.

BACKGROUND OF THE DISCLOSURE

Audio encoding is a process of generating digital codes through a series of processing on sound in an energy wave form, to ensure that a sound signal occupies a relatively small transmission bandwidth and storage space during transmission and has a relatively high sound quality.

In actual application, an audio signal is encoded generally based on an audio encoder, and encoding quality mainly depends on whether encoding parameters configured for the audio encoder are suitable. Based on this, to achieve better encoding quality, in a related technical solution, the encoding parameters are generally adaptively configured based on a device processing capacity and a network bandwidth feature during audio encoding. For example, a high bit rate and a high sampling rate are configured under a high sound quality service requirement, to achieve better source encoding quality.

However, in actual application, although a higher bit rate and a higher sampling rate used for source encoding of a transmitter lead to higher source encoding quality, a receiver cannot clearly hear sound of the transmitter, not to mention distinguishing the sound quality. Therefore, encoding quality conversion efficiency is relatively low, and a voice call effect is not good.

Based on this, currently, there is an urgent need to provide a solution to adaptively configure the encoding parameters and improve the encoding quality conversion efficiency, thereby ensuring the voice call effect.

SUMMARY

Embodiments of this application provide an encoding parameter adjustment method and apparatus, a device, and a storage medium, to effectively improve encoding quality conversion efficiency and ensure a better voice call effect between a transmitting end and a receiving end.

In view of this, a first aspect of this application provides an encoding parameter adjustment method, applicable to a device with a data processing capability, the method including:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate.

A second aspect of this application provides an encoding parameter adjustment apparatus, applicable to a device with a data processing capability, the apparatus including:

a psychoacoustic masking threshold determining module, configured to obtain a first audio signal recorded by a transmitting end, and determine a psychoacoustic masking threshold of each frequency within a service frequency band designated by a target service in the first audio signal;

a background environmental noise estimation value determining module, configured to obtain a second audio signal recorded by a receiving end, and determine a background environmental noise estimation value of the frequency within the service frequency band in the second audio signal;

a masking tagging module, configured to determine a masking tag corresponding to the frequency within the service frequency band according to the psychoacoustic masking threshold of the frequency within the service frequency band in the first audio signal and the background environmental noise estimation value of the frequency within the service frequency band in the second audio signal;

a masking rate determining module, configured to determine a masking rate of the service frequency band according to the masking tag corresponding to the frequency within the service frequency band;

a first reference bit rate determining module, configured to determine a first reference bit rate according to the masking rate of the service frequency band; and a configuration module, configured to configure an encoding bit rate of an audio encoder based on the first reference bit rate.

A third aspect of this application provides a computer device, including a processor and a memory, the memory being configured to store a plurality of computer programs; and the processor being configured to perform the encoding parameter adjustment method according to the first aspect according to the computer programs.

A fourth aspect of this application provides a non-transitory computer-readable storage medium, configured to store a computer program, the computer program being configured to perform the encoding parameter adjustment method according to the first aspect.

A fifth aspect of this application provides a computer program product including instructions, the instructions, when run on a computer, causing the computer to perform the encoding parameter adjustment method according to the first aspect.

It can be seen from the foregoing technical solution that the embodiments of this application have the following advantages:

The embodiments of this application provide an encoding parameter adjustment method. In this method, from the perspective of optimal coordination of end-to-end effects, based on a background environmental noise condition fed back by the receiving end, encoding parameters used for audio encoding at the transmitting end are adjusted, so as to ensure that the receiving end can clearly hear the audio signal transmitted by the transmitting end. In the encoding parameter adjustment method provided in the embodiments of this application, the method includes: obtaining a first audio signal recorded by a transmitting end, and determining a psychoacoustic masking threshold of each frequency within a service frequency band designated by a target service in the first audio signal; obtaining a second audio signal recorded by a receiving end, and determining a background environmental noise estimation value of the frequency within the service frequency band in the second audio signal; determining a masking tag corresponding to the frequency within the service frequency band according to the psychoacoustic masking threshold of the frequency within the service frequency band in the first audio signal and the background environmental noise estimation value of the frequency within the service frequency band in the second audio signal; further determining a masking rate of the service frequency band according to the masking tag corresponding to the frequency within the service frequency band, and determining a first reference bit rate according to the masking rate of the service frequency band; and finally configuring an encoding bit rate of an audio encoder based on the first reference bit rate. In this way, whether noise in a background environment in which the receiving end is actually located may generate masking on the audio signal transmitted by the transmitting end is determined according to the psychoacoustic masking threshold of the frequency within the service frequency band in the first audio signal acquired by the transmitting end and the background environmental noise estimation value of the frequency within the service frequency band in the second audio signal acquired by the receiving end, and the encoding parameters of the audio encoder are adjusted for the purpose of reducing or eliminating the masking, thereby improving the encoding quality conversion efficiency of the audio signal and ensuring a better voice call effect between the transmitting end and the receiving end.

DESCRIPTION OF EMBODIMENTS

Figure 1:
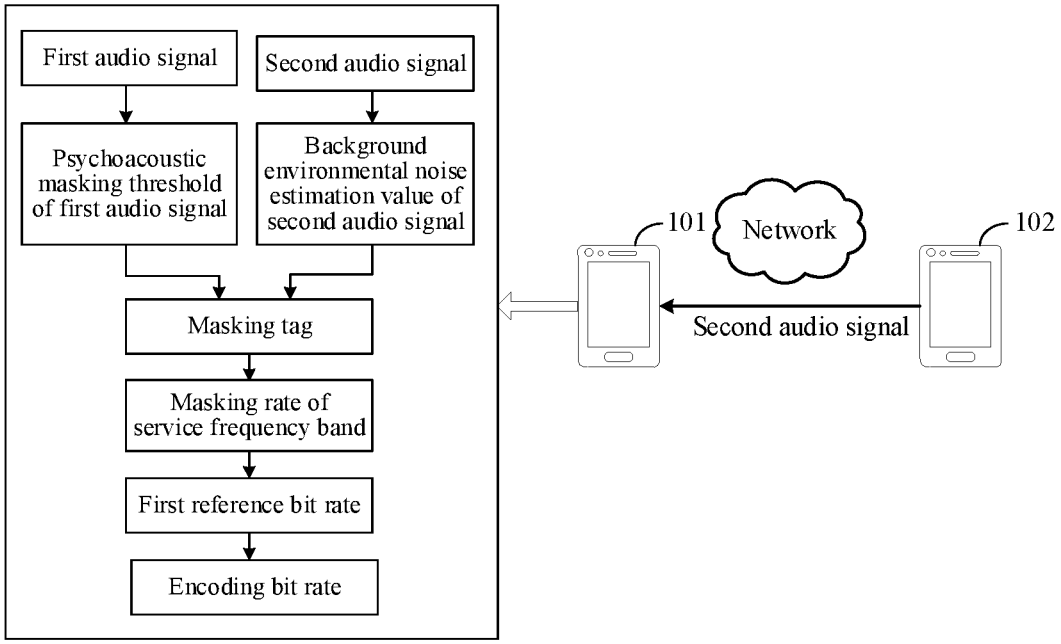
FIG. 1 is a schematic diagram of an application scenario of an encoding parameter adjustment method according to an embodiment of this application.

To make a person skilled in the art understand solutions of this application better, the following clearly and completely describes the technical solution in the embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts shall fall within the protection scope of this application.

In the specification, claims, and accompanying drawings of this application, the terms "first", "second", "third", "fourth", and so on (if existing) are intended to distinguish between similar objects rather than describe a specific order or sequence. The data used in this way may be interchanged in an appropriate case, so that the embodiments of this application described herein can be implemented in a sequence other than the sequence illustrated or described herein. Moreover, the terms "include", "contain" and any other variants mean to cover the non-exclusive inclusion, for example, a process, method, system, product, or device that includes a list of steps or units is not necessarily limited to those expressly listed steps or units, but may include other steps or units not expressly listed or inherent to such a process, method, system, product, or device.

In the related art, encoding parameters used during audio encoding are adaptively adjusted generally based on factors as a device processing capability and a network bandwidth. However, in actual application, it usually occurs that, a receiver still cannot clearly hear an audio signal transmitted by a transmitting end even if a higher encoding bit rate and sampling rate are used by the transmitting end to achieve higher source coding quality. That is, adjusting the encoding parameters of the audio signal based on the encoding parameter adjustment method in the related art usually cannot achieve a better voice call effect.

The reason why the encoding parameter adjustment method provided in the related art cannot achieve the better voice call effect is that in the related art, when the audio encoding parameters are adjusted, only audio signal quality and transmission quality are considered, while the influence of an auditory acoustic environment (for example, a background environment) in which the call receiver is located on the audio signal heard by the receiver is ignored. However, in many cases, the auditory acoustic environment of the receiver often determines whether the receiver can clearly hear the audio signal transmitted by the transmitting end.

Based on this, the embodiments of this application provide an encoding parameter adjustment method. In this method, from the perspective of optimal coordination of end-to-end effects, considering the influence of the auditory acoustic environment in which the receiving end (corresponding to the receiver) is actually located on the audio signal transmitted by the transmitting end (corresponding to a transmitter), end-to-end closed-loop feedback adjustment on the encoding parameters is implemented based on a background environmental noise estimation value fed back by the receiving end, thereby effectively improving encoding quality conversion efficiency of the audio signal and ensuring a better voice call effect between the transmitting end and the receiving end.

The encoding parameter adjustment method provided in the embodiments of this application is applicable to a device with a data processing capability, such as a terminal device or a server. The terminal device may be specifically a smartphone, a computer, a personal digital assistant (PDA), a tablet computer, or the like, and the server may be specifically an application server, or may be a web server. During actual application deployment, the server may be an independent server, or may be a cluster server.

When the encoding parameter adjustment method provided in the embodiments of this application is performed by a terminal device, the terminal device may be a transmitting end of an audio signal, or may be a receiving end of an audio signal. If the terminal device is a transmitting end of an audio signal, the terminal device needs to obtain, from a corresponding receiving end, a second audio signal recorded by the receiving end, and then perform the encoding parameter adjustment method provided in the embodiments of this application, to configure encoding parameters for the audio signal to be transmitted. If the terminal device is a receiving end of an audio signal, the terminal device needs to obtain, from a corresponding transmitting end, a first audio signal recorded by the transmitting end, and then perform the encoding parameter adjustment method provided in the embodiments of this application, to configure encoding parameters for the audio signal to be transmitted by the transmitting end, and transmit the configured encoding parameters to the transmitting end, so that the transmitting end encodes, based on the encoding parameters, the audio signal to be transmitted.

When the encoding parameter adjustment method provided in the embodiments of this application is performed by a server, the server may obtain a first audio signal from a transmitting end of the audio signal, obtain a second audio signal from a receiving end of the audio signal, and then perform the encoding parameter adjustment method provided in the embodiments of this application, to configure encoding parameters for the audio signal to be transmitted by the transmitting end, and transmit the configured encoding parameters to the transmitting end, so that the transmitting end encodes, based on the encoding parameters, the audio signal to be transmitted.

For ease of understanding the technical solution provided in the embodiments of this application, the following uses an example in which the encoding parameter adjustment method provided in the embodiments of this application is applicable to a terminal device serving as a transmitting end, to exemplarily describe an application scenario of the encoding parameter adjustment method provided in the embodiments of this application.

FIG. 1 is a schematic diagram of an application scenario of an encoding parameter adjustment method according to an embodiment of this application. As shown in FIG. 1, the application scenario includes a terminal device 101 and a terminal device 102. The terminal device 101 is used as a transmitting end of a real-time call, the terminal device 102 is used as a receiving end of the real-time call, and the terminal device 101 and the terminal device 102 may communicate with each other through a network. The terminal device 101 is configured to perform the encoding parameter adjustment method provided in the embodiments of this application, and correspondingly configure encoding parameters for an audio signal to be transmitted.

During application, the terminal device 101 obtains a first audio signal recorded by the terminal device 101 by using a microphone, the first audio signal being an audio signal transmitted by the terminal device 101 to the terminal device 102 during a real-time call, and further determines a psychoacoustic masking threshold of each frequency within a service frequency band designated by a target service in the first audio signal. The terminal device 101 obtains, through the network, a second audio signal recorded by the terminal device 102 by using a microphone, the second audio signal being an audio signal in a background environment of the terminal device 102 during a real-time call, and further determines a background environmental noise estimation value of the frequency within the service frequency band in the second audio signal.

The terminal device 101 correspondingly determines a masking tag corresponding to the frequency within the service frequency band according to the psychoacoustic masking threshold of the frequency within the service frequency band in the first audio signal and the background environmental noise estimation value of the frequency within the service frequency band in the second audio signal, that is, determines whether the audio signal transmitted by the transmitting end is masked by background environmental noise of the receiving end at the frequency within the service frequency band. Further, the terminal device 101 determines a masking rate of the service frequency band according to the masking tag corresponding to the frequency within the service frequency band. The masking rate of the service frequency band can represent a ratio of the number of masked frequencies to the total number of frequencies. In addition, the terminal device determines a first reference bit rate according to the masking rate of the service frequency band, and configures an encoding bit rate of an audio encoder based on the first reference bit rate, that is, configures the encoding bit rate for the audio signal to be transmitted by the terminal device 101.

In this way, when the terminal device 101 determines the encoding bit rate, considering the influence of an auditory acoustic environment in which the receiving end (that is, the terminal device 102) is actually located on the audio signal transmitted by the transmitting end, end-to-end closed-loop feedback adjustment on the encoding bit rate is implemented based on the background environmental noise estimation value of the frequency within the service frequency band in the second audio signal fed back by the receiving end, thereby ensuring that the audio signal encoded based on the encoding bit rate obtained through such adjustment can be clearly and effectively heard by a receiver corresponding to the receiving end.

The application scenario shown in FIG. 1 is merely an example. In actual application, the encoding parameter adjustment method provided in the embodiments of this application is not only applicable to an application scenario of a two-person real-time call, but also applicable to an application scenario of a multi-person real-time call, and even further applicable to other application scenarios in which an audio signal needs to be transmitted. The application scenario of the encoding parameter adjustment method provided in the embodiments of this application is not limited herein.

The following describes, through embodiments, the encoding parameter adjustment method provided in this application.

Figure 2:
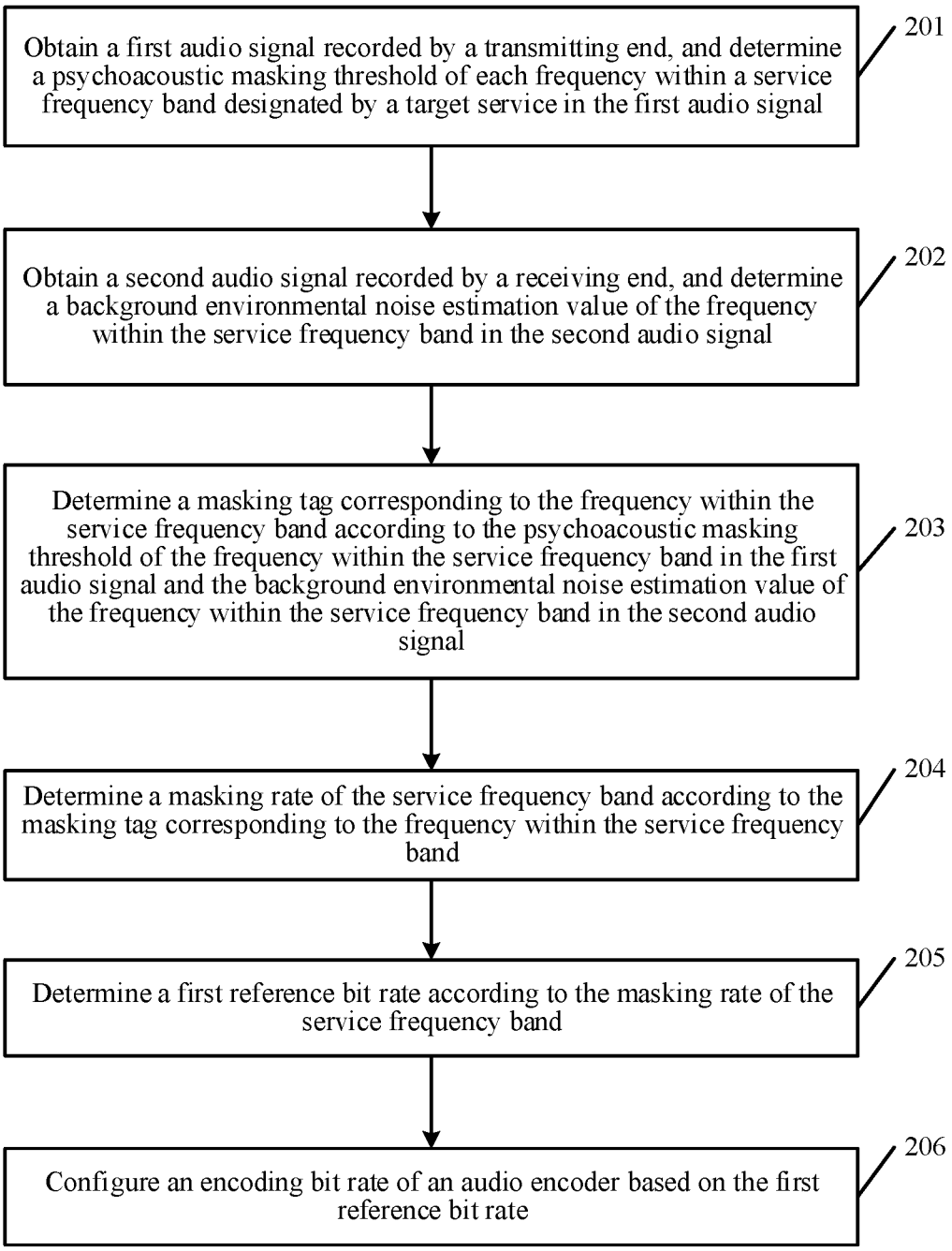
FIG. 2 is a schematic flowchart of an encoding parameter adjustment method according to an embodiment of this application.

FIG. 2 is a schematic flowchart of an encoding parameter adjustment method according to an embodiment of this application. For ease of description, an execution entity being a terminal device serving as a transmitting end is taken as an example to describe the encoding parameter adjustment method in the following embodiments. As shown in FIG. 2, the encoding parameter adjustment method includes the following steps:

Step 201. Obtain a first audio signal recorded by a transmitting end, and determine a psychoacoustic masking threshold of each frequency within a service frequency band designated by a target service in the first audio signal.

The terminal device obtains the first audio signal recorded by a microphone configured on the terminal device. The first audio signal may be an audio signal that needs to be transmitted to another terminal device by the terminal device when the terminal device performs a real-time call with the another terminal device. The first audio signal may alternatively be an audio signal recorded by the terminal device in another scenario in which the audio signal needs to be transmitted. A scenario of generating the first audio signal is not limited herein.

The target service refers to an audio service to which the first audio signal currently belongs. The audio service may be roughly classified as a voice service, a music service, or another service type supporting audio transmission, or may be more finely classified according to a frequency range involved in the service. The service frequency band designated by the target service refers to a frequency range with highest importance in the target service, that is, a frequency range capable of bearing audio signals generated during the service, which is also a frequency range on which each service focuses.

For example, a service frequency band designated by a voice service (such as a real-time voice call or voice transmission service) is generally a frequency band below 3.4 kHz, that is, a medium-low frequency band. For example, a music service generally involves an entire frequency band. Therefore, a service frequency band designated by the music service is a full frequency band of audio supported by a device, which is also referred to as a full frequency range.

After obtaining the first audio signal, the terminal device further determines the psychoacoustic masking threshold of the frequency within the service frequency band in the audio signal. Currently, there are some relatively mature methods for calculating a psychoacoustic masking threshold in the related art. In this application, the psychoacoustic masking threshold of the frequency in the first audio signal can be calculated with direct reference to the existing methods for calculating a psychoacoustic masking threshold in the related art.

Because the psychoacoustic masking threshold needs to be obtained through calculation based on a power spectrum of the first audio signal, the power spectrum of the first audio signal needs to be first calculated before the psychoacoustic masking threshold of the frequency within the service frequency band in the first audio signal is calculated.

In some embodiments, the first audio signal acquired by the microphone of the terminal device may be first converted from a time domain signal to a frequency domain signal through framing windowing processing and discrete Fourier transformation. When framing windowing processing is performed on the time domain signal, a window with a length of 20 ms per frame is used as an example, a Hamming window may be specifically selected as the window herein, and a window function is shown in Formula (1):

$$\text{win}\ (n) = 0.5 * \left(1 + \cos\left(2\pi \frac{n}{N-1}\right)\right) \tag{1}$$

where n belongs to $$\left[-\frac{N-1}{2}, \frac{N-1}{2}\right],$$

and N is a length of a single window, that is, the total number of sample points in the single window.

After the framing windowing processing, Fourier transformation is further performed on the first audio signal, and a specific transformation manner is shown in Formula (2):

$$X(i,k) = \sum_{n=0}^{N-1} x(n)\ \text{win}\ (n) e^{-j\frac{2\pi nk}{N}} \tag{2}$$

After the Fourier transformation, a power spectrum value of the frequency in the first audio signal is further calculated based on Formula (3):

$$S(i,k) = |X(i,k)|^2 k = 1,2,3, \ldots, N \tag{3}$$

Next, a Johnston masking threshold calculation method is used as an example. The psychoacoustic masking threshold of the frequency in the first audio signal is further calculated based on the power spectrum value obtained through calculation in Formula (3).

Human ears can distinguish discrete band-pass filter banks, and respective critical frequencies corresponding to the filters are specifically divided as shown in Table 1. One critical frequency band is generally referred to as one Bark.

TABLE 1

| | Frequency (Hz) | | |
|---|---|---|---|
| Key band number | Low end | High end | Center frequency |
| 0 | 0 | 100 | 50 |
| 1 | 100 | 200 | 150 |
| 2 | 200 | 300 | 250 |
| 3 | 300 | 400 | 350 |
| 4 | 400 | 510 | 450 |
| 5 | 510 | 630 | 570 |
| 6 | 630 | 770 | 700 |
| 7 | 770 | 920 | 840 |
| 8 | 920 | 1080 | 1000 |
| 9 | 1080 | 1270 | 1175 |
| 10 | 1270 | 1480 | 1370 |
| 11 | 1480 | 1720 | 1600 |
| 12 | 1720 | 2000 | 1850 |
| 13 | 2000 | 2320 | 2150 |
| 14 | 2320 | 2700 | 2500 |
| 15 | 2700 | 3150 | 2900 |
| 16 | 3150 | 3700 | 3400 |
| 17 | 3700 | 4400 | 4000 |
| 18 | 4400 | 5300 | 4800 |
| 19 | 5300 | 6400 | 5800 |
| 20 | 6400 | 7700 | 7000 |
| 21 | 7700 | 9500 | 8500 |

TABLE 1-continued

| Key band number | Frequency (Hz) Low end | High end | Center frequency |
|---|---|---|---|
| 22 | 9500 | 12000 | 10500 |
| 23 | 12000 | 15500 | 13500 |
| 24 | 15500 | 22050 | 19500 |

A linear frequency may be converted to a Bark domain based on Formula (4):

$$z(f)=13*\arctan(0.76*f_{khz})+3.5*\arctan(f_{khz}/7.5^2) \quad (4)$$

where z(f) is a Bark domain value corresponding to a frequency $f_{khz}$.

Then, a signal power spectrum in the Bark domain is calculated based on Formula (5):

$$B(i,z)=\Sigma_{i-b1(m)}^{b2(m)}P(i.l) \quad (5)$$

where $b_1(m)$ and $b_2(m)$ represent frequency index numbers corresponding to upper and lower limit frequencies of an $m^{th}$ Bark domain respectively, and P(i, l) is the power spectrum value obtained through calculation based on Formula (3).

Next, a spread function SF(m) is calculated, and the function used herein is a spread function proposed by Schroeder, as shown in Formula (6):

$$SF(\delta z)=15.81+7.5*(\delta z+0.474)-17.5*\sqrt{1+(\delta z+0.474)^2)} \quad (6)$$

δz is equal to a Bark domain index value of a masked signal minus a Bark domain index value of a masked signal. Considering mutual interference between frequency bands, a spread Bark spectrum may be expressed as C(i, z)=B(i, z)×$SF(\delta z)$.

Further, a global noise masking value of a Bark sub-band is calculated. The global noise masking value T'(z) of the Bark sub-band is equal to a maximum value between a sub-band noise masking threshold and an absolute hearing threshold. A specific calculation formula of the sub-band noise masking threshold T(i, z) is shown in Formula (7):

$$T(i,z)=10^{\log 10(C(i,z)-5.5)} \quad (7)$$

where z is the Bark domain index value.

A specific calculation formula of the absolute hearing threshold $T_{abs}(z)$ is shown in Formula (8):

$$T_{abs}(z)=3.64*(btof(z))^{-0.08}-6.5\exp((btof(z))-3.3)^2+10^{-3}(btof(z))^4 \quad (8)$$

A formula for conversion from the Bark domain to the linear frequency is as shown in Formula (9):

$$\text{if: } z<1 \rightarrow b=\frac{z-0.3}{0.85} \quad (9)$$

$$\text{if: } z>19.1 \rightarrow b=\frac{z+4.422}{1.22}$$

$$\text{else: } b=z$$

$$btof(z)=1.96*\frac{b+0.47}{25.28-b}$$

Finally, a psychoacoustic masking threshold for conversion from a sound pressure level to an electron domain is calculated based on Formula (10):

$$P_{mark}(i,f)=10^{0.1*(T(i,z(f))-PN)} \quad (10)$$

In actual application, the psychoacoustic masking threshold of the frequency within the service frequency band in the first audio signal may alternatively be calculated by using other methods for calculating a psychoacoustic masking threshold in addition to the foregoing method for calculating a psychoacoustic masking threshold. The method for calculating a psychoacoustic masking threshold used in this application is not limited herein.

Step 202. Obtain a second audio signal recorded by a receiving end, and determine a background environmental noise estimation value of the frequency within the service frequency band in the second audio signal.

To ensure that the receiving end can clearly hear the first audio signal transmitted by the transmitting end, the terminal device serving as the transmitting end further needs to obtain, from a receiving end, a second audio signal recorded by the receiving end, and further determines a background environmental noise estimation value of the frequency within the service frequency band in the second audio signal based on the obtained second audio signal. In this way, encoding parameters of the transmitting end are reversely adjusted according to a background environmental noise condition of the receiving end.

In actual application, the terminal device serving as the receiving end may alternatively obtain a second audio signal recorded by the terminal device, and the terminal device serving as the receiving end determines a background environmental noise estimation value of the frequency within the service frequency band in the second audio signal, and further transmits the background environmental noise estimation value of the frequency within the service frequency band in the second audio signal to the terminal device serving as the transmitting end. That is, in actual application, not only the terminal device serving as the receiving end may determine the background environmental noise estimation value of the frequency within the service frequency band in the second audio signal, but also the terminal device serving as the transmitting end may determine the background environmental noise estimation value of the frequency within the service frequency band in the second audio signal.

In some embodiments, the terminal device may determine the background environmental noise estimation value of the frequency within the service frequency band based on the second audio signal and by using a minima controlled recursive averaging (MCRA) algorithm. For example, the terminal device may first determine a power spectrum of the second audio signal, and perform time-frequency domain smoothing processing on the power spectrum of the second audio signal; then the terminal device determines a minimum value of a voice with noise as a rough estimation of the noise based on the power spectrum after the time-frequency domain smoothing processing and by using a minimum tracking method; further, the terminal device determines a voice existence probability according to the rough estimation of the noise and the power spectrum after the time-frequency domain smoothing processing, and determines the background environmental noise estimation value of the frequency within the service frequency band in the second audio signal according to the voice existence probability.

When determining the power spectrum of the second audio signal, the terminal device may first convert the second audio signal from a time domain signal to a frequency domain signal through framing windowing processing and discrete Fourier transformation, and further determine the power spectrum of the second audio signal based on the frequency domain signal obtained through conversion. A manner in which the power spectrum of the second audio signal is determined is the same as a manner in which the power spectrum of the first audio signal is determined. For details, refer to the foregoing implementation of determining the power spectrum of the first audio signal based on Formula (1) to Formula (3).

Then, the terminal device performs time-frequency domain smoothing processing on the power spectrum of the second audio signal, and specific processing is implemented based on Formula (11) and Formula (12):

$$\overline{S_f}(i,k)=\frac{1}{2w}\sum_{j=-w}^{w}b(j+w)+S(i,k+j) \tag{11}$$

where $\overline{S_f}(i,k)$is a power spectrum after frequency domain smoothing processing, S(i, k+j) is a power spectrum value of the second audio signal, and b is a weighting factor group for frequency domain smoothing, for example, b[5]=[0.1, 0.2, 0.4, 0.2, 0.1].

$$\overline{S}(i,k)=a_0\overline{S}(i-1,k)+(1-a_0)\overline{S_f}(i,k) \tag{12}$$

where $\overline{S}(i, k)$is a power spectrum after time domain smoothing processing, and $a_0$ is a time domain smoothing factor, for example, $a_0=0.9$.

Next, the minimum value $S_{min}(i, k)$of the voice with noise is determined as the rough estimation of the noise by using the minimum value tracking method. If mod(k, d) is equal to 0, $S_{min}(i, k)$ is calculated based on Formula (13) and Formula (14):

$$S_{min}(i,k)=\min(S_{tmp}(i-1,k),\overline{S}(i,k)) \tag{13}$$

$$S_{tmp}(i,k)=\overline{S}(i,k) \tag{14}$$

If mod(k, d)is not equal to 0, $S_{min}(i, k)$ is calculated based on Formula (15) and Formula (16):

$$S_{min}(i,k)=\min(S_{tmp}(i-1,k),\overline{S}(i,k)) \tag{15}$$

$$S_{tmp}(i,k)=\min(S_{tmp}(i-1,k),\overline{S}(i,k)) \tag{16}$$

Further, according to the power spectrum after the time-frequency domain smoothing processing obtained through calculation according to Formula (11) and Formula (12) and the rough estimation of the noise obtained through calculation according to Formula (13) to Formula (16), the voice existence probability $\hat{p}(i, k)$ is calculated by using Formula (17), Formula (18), and Formula (19):

$$S_r(i,k)=\overline{S}(i,k)/S_{min}(i,k) \tag{17}$$

$$p(i,k)=\begin{cases}1, & S_r(i,k)>\delta\\ 0, & S_r(i,k)\le\delta\end{cases} \tag{18}$$

$$\hat{p}(i,k)=a_p\hat{p}(i-1,k)+(1-a_p)p(i,k) \tag{19}$$

Finally, the voice existence probability $\hat{p}(i, k)$ is obtained through calculation according to Formula (19), and the background environmental noise estimation value $\widehat{S_n}(i, k)$ of the frequency in the second audio signal is determined based on Formula (20):

$$\widehat{S_n}(i,k)=\hat{p}(i,k)\widehat{S_n}(i-1,k)+(1-\hat{p}(i,k))\widehat{S_n}(i,k) \tag{20}$$

In actual application, the background environmental noise estimation value of the frequency within the service frequency band in the second audio signal may alternatively be calculated by using other algorithms in addition to the MCRA algorithm. The method for calculating the background environmental noise estimation value used in this application is not limited herein.

In actual application, the terminal device may first perform step 201 and then perform step 202, or may first perform step 202 and then perform step 201, or may perform step 201 and step 202 simultaneously. An execution sequence of step 201 and step 202 provided in this embodiment of this application is not limited herein.

Step 203. Determine a masking tag corresponding to the frequency within the service frequency band according to the psychoacoustic masking threshold of the frequency within the service frequency band in the first audio signal and the background environmental noise estimation value of the frequency within the service frequency band in the second audio signal.

After obtaining the psychoacoustic masking threshold of the frequency within the service frequency band in the first audio signal and the background environmental noise estimation value of the frequency within the service frequency band in the second audio signal through calculation, the terminal device further determines the masking tag corresponding to the frequency within the service frequency band according to the psychoacoustic masking threshold and the background environmental noise estimation value. The masking tag may be used for identifying whether the audio signal transmitted by the transmitting end is masked by background environmental noise of the receiving end at the frequency within the service frequency band. That is, the terminal device determines whether the audio signal transmitted by the transmitting end is masked by the background environmental noise of the receiving end at the frequency within the service frequency band. If the psychoacoustic masking threshold of the frequency is far less than the background environmental noise estimation value of the frequency, it may be considered that the audio signal recorded by the transmitting end has a low probability of being clearly heard by the receiving end at the frequency and is likely to be masked by the background environmental noise of the receiving end; otherwise, it may be considered that the audio recorded by the transmitting end has a high probability of being clearly heard by the receiving end at the frequency and is not masked by the background environmental noise of the receiving end.

The masking tag may be represented by 0 or 1. If the audio signal transmitted by the transmitting end is not masked by the background environmental noise of the receiving end at the frequency within the service frequency band, the masking tag may be 0. If the audio signal transmitted by the transmitting end is masked by the background environmental noise of the receiving end at the frequency within the service frequency band, the masking tag may be 1.

In some embodiments, a magnitude relationship between the psychoacoustic masking threshold and the background environmental noise estimation value may be represented by a ratio between the background environmental noise estimation value and the psychoacoustic masking threshold. Therefore, the masking tag may be determined by determining a magnitude relationship between the ratio obtained through calculation and a preset threshold ratio. The terminal device may preset a threshold ratio β, further calculate a ratio between the background environmental noise estimation value and the psychoacoustic masking threshold at the frequency within the service frequency band, and determine whether the ratio obtained through calculation is greater than the threshold ratio β. If so, it indicates that the audio signal recorded by the transmitting end may be masked by the background environmental noise of the receiving end, and the masking tag is correspondingly set to 1; otherwise, if the ratio obtained through calculation is less than or equal to the threshold ratio β, it indicates that the audio signal recorded by the transmitting end is not masked by the background environmental noise of the receiving end, and the masking tag is correspondingly set to 0.

In actual application, the terminal device may set the threshold ratio β according to actual requirements. A value of the threshold ratio β is not specifically limited herein.

In actual application, the masking tag corresponding to the frequency within the service frequency band may alternatively be determined in other manners in addition to the foregoing manner. The manner of determining the masking tag corresponding to the frequency within the service frequency band in this application is not limited herein.

Step 204. Determine a masking rate of the service frequency band according to the masking tag corresponding to the frequency within the service frequency band.

After determining the masking tag corresponding to the frequency within the service frequency band, the terminal device further determines the masking rate of the service frequency band according to the determined masking tag of the frequency within the service frequency band. The masking rate of the service frequency band can represent a ratio of the number of masked frequencies within the service frequency band in the first audio signal to the total number of frequencies.

During implementation, the terminal device may calculate the masking rate of the service frequency band based on Formula (21):

$$\text{Ratio}_{mark_global}=(\Sigma_{k=0}^{K2}\text{flag}(k))/(K2+1) \quad (21)$$

where $\text{Ratio}_{mark_global}$ is the masking rate of the service frequency band, and K2 is a highest frequency in the first audio signal.

Step 205. Determine a first reference bit rate according to the masking rate of the service frequency band.

After determining the masking rate of the service frequency band, the terminal device further determines the first reference bit rate according to the masking rate of the service frequency band. The first reference bit rate may be used as reference data for finally determining an encoding bit rate of an audio encoder.

In an implementation, the terminal device may select the first reference bit rate from a preset first available bit rate and a preset second available bit rate based on the masking rate of the service frequency band. The terminal device may use the preset first available bit rate as the first reference bit rate in a case that the masking rate of the service frequency band is less than a first preset threshold. The terminal device may use the second available bit rate as the first reference bit rate in a case that the masking rate of the service frequency band is not less than the first preset threshold. The preset second available bit rate is less than the preset first available bit rate.

For example, assuming that the first preset threshold a2=0.5, when the masking rate $\text{Ratio}_{mark_global}$ of the service frequency band is less than 0.5, it indicates that the ratio of the number of masked frequencies within the service frequency band in the first audio signal to the total number of frequencies is relatively low, and a possibility that the audio signal transmitted by the transmitting end is masked by the background environmental noise of the receiving end is relatively low. In this case, a larger preset first available bit rate may be selected as the first reference bit rate, to perform high-quality encoding on the audio signal. When $\text{Ratio}_{mark_global}$ is greater than or equal to 0.5, it indicates that the ratio of the number of masked frequencies within the service frequency band in the first audio signal to the total number of the frequencies is relatively high, and the audio signal transmitted by the transmitting end is highly possible to be masked by the background environmental noise of the receiving end. In this case, there is little significance to perform high-quality encoding by using a high bit rate, and therefore, an encoding bit rate that is acceptable in quality and relatively low in value may be correspondingly selected as the first reference bit rate. That is, the smaller preset second available bit rate is selected as the first reference bit rate.

In actual application, the first preset threshold may be set according to actual requirements. The first preset threshold is not specifically limited herein. In actual application, the preset first available bit rate and the preset second available bit rate may alternatively be set according to actual requirements. The preset first available bit rate and the preset second available bit rate are not specifically limited herein either.

In another implementation, to ensure higher accuracy of a configuration result of the first reference bit rate, the terminal device may preset a plurality of adjacent threshold intervals, each adjacent threshold interval being corresponding to a different reference bit rate, and further select the first reference bit rate from a plurality of reference bit rates based on the masking rate of the service frequency band.

Therefore, the terminal device may match the masking rate of the service frequency band with the plurality of preset adjacent threshold intervals, and determine an adjacent threshold interval matching the masking rate of the service frequency band as a target threshold interval, different adjacent threshold intervals herein being corresponding to different reference bit rates; and use a reference bit rate corresponding to the target threshold interval as the first reference bit rate.

For example, the adjacent threshold intervals preset by the terminal device include [0, 0.2), [0.2, 0.4), [0.4, 0.6), [0.6, 0.8) and [0.8, 1], and the masking rate $\text{Ratio}_{mark_global}$ of the service frequency band obtained through calculation by the terminal device is 0.7. If $\text{Ratio}_{mark_global}$ matches the adjacent threshold interval [0.6, 0.8), the terminal device may select a reference bit rate corresponding to the threshold interval [0.6, 0.8) as the first reference bit rate.

The foregoing adjacent threshold intervals are merely an example. In actual application, the terminal device may obtain a plurality of adjacent threshold intervals in other forms through division. The first reference bit rate based on which the adjacent threshold interval is determined is not limited herein. In addition, the reference bit rate corresponding to each threshold interval may alternatively be set according to actual requirements. The reference bit rate corresponding to the threshold interval is not specifically limited herein.

Step 206. Configure an encoding bit rate of an audio encoder based on the first reference bit rate.

After determining the first reference bit rate, the terminal device further configures the encoding bit rate of the audio encoder of the terminal device based on the first reference bit rate, so that the terminal device encodes, based on the encoding bit rate, the audio signal transmitted to the receiving end.

In an implementation, the terminal device may directly configure the first reference bit rate determined in step 205 as the encoding bit rate of the audio encoder.

In another implementation, to ensure that the audio signal obtained through encoding not only can be clearly heard by the receiving end, but also can be successfully transmitted to the receiving end without frame freezing, a packet loss, and the like during transmission, the terminal device may determine the encoding bit rate of the audio encoder by combining the first reference bit rate and the second reference bit rate determined according to a network bandwidth. In this case, the terminal device may obtain the second reference bit rate, the second reference bit rate being determined according to the network bandwidth; and further select a minimum value between the first reference bit rate and the second reference bit rate to be assigned to the encoding bit rate of the audio encoder.

During implementation, the terminal device may estimate a current uplink network bandwidth, and set, based on an estimation result, a second reference bit rate for the audio encoder that may be used when the audio encoder encodes the audio signal. The audio signal to be transmitted is encoded based on the second reference bit rate, to ensure that the frame freezing, the packet loss, and the like do not occur during transmission of the audio signal. Further, the terminal device selects the minimum value from the second reference bit rate and the first reference bit rate determined in step 205 as the encoding bit rate assigned to the audio encoder.

In this way, based on the minimum value between the first reference bit rate and the second reference bit rate, the audio signal to be transmitted by the transmitting end is encoded, to ensure that the audio signal transmitted to the receiving end is not masked by the background environmental noise of the receiving end, and the frame freezing, the packet loss, and the like do not occur during transmission of the audio signal.

In the foregoing encoding parameter adjustment method, from the perspective of optimal coordination of end-to-end effects, considering the influence of an auditory acoustic environment in which the receiving end is actually located on the audio signal transmitted by the transmitting end, end-to-end closed-loop feedback adjustment on the encoding parameters of the audio signal is implemented based on the background environmental noise estimation value fed back by a receiver, thereby effectively improving encoding quality conversion efficiency of the audio signal and ensuring a better voice call effect between the transmitting end and the receiving end.

To ensure that the receiving end can hear the audio signal transmitted by the transmitting end more clearly, in the encoding parameter adjustment method provided in the embodiments of this application, in addition to the encoding bit rate used by the audio encoder, the encoding sampling rate used by the audio encoder may be further adjusted. That is, in the encoding parameter adjustment method provided in the embodiments of this application, the encoding sampling rate used during audio encoding may also be adaptively adjusted according to the background environmental noise condition fed back by the receiving end, thereby ensuring a better effect of the audio signal heard at the receiving end.

Figure 3:
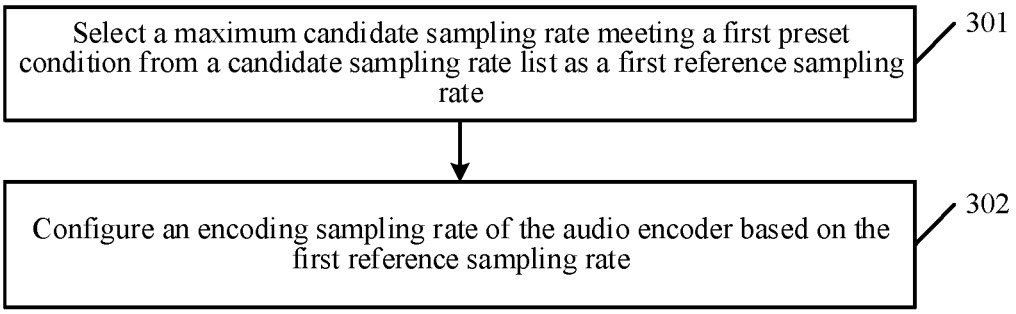
FIG. 3 is a schematic flowchart of an encoding sampling rate adjustment method according to an embodiment of this application.

In the encoding parameter adjustment method provided in the embodiments of this application, before the encoding bit rate of the audio encoder is configured, the encoding sampling rate is adjusted by performing the following method shown in FIG. 3, and the encoding bit rate of the audio encoder is further configured based on the first reference bit rate determined in the method shown in FIG. 2 and the second reference bit rate matching the adjusted encoding sampling rate, so that the configured encoding bit rate matches a current environment better.

An encoding sampling rate adjustment method provided in the embodiments of this application is described below with reference to FIG. 3. FIG. 3 is a schematic flowchart of an encoding sampling rate adjustment method according to an embodiment of this application. For ease of description, an execution entity being a terminal device serving as a transmitting end is taken as an example to describe the encoding sampling rate adjustment method in the following embodiments. As shown in FIG. 3, the encoding sampling rate adjustment method includes the following steps:

Step 301. Select a maximum candidate sampling rate meeting a first preset condition from a candidate sampling rate list as a first reference sampling rate.

The first preset condition is that a masking rate of a target frequency band corresponding to a candidate sampling rate is greater than a second preset threshold, the target frequency band of the candidate sampling rate refers to a frequency region above a target frequency corresponding to the candidate sampling rate, and the target frequency corresponding to the candidate sampling rate is determined according to a highest frequency corresponding to the candidate sampling rate and a preset ratio.

The terminal device may determine whether each candidate sampling rate in the candidate sampling rate list meets the first preset condition, that is, determine whether a masking value of a target frequency band corresponding to the candidate sampling rate is greater than a second preset threshold, and further select the maximum candidate sampling rate from the candidate sampling rates meeting the first preset condition as the first reference sampling rate.

The target frequency band corresponding to the candidate sampling rate specifically refers to the frequency region above the target frequency corresponding to the candidate sampling rate, the target frequency corresponding to the candidate sampling rate is determined according to the highest frequency corresponding to the candidate sampling rate and the preset ratio, and the highest frequency corresponding to the candidate sampling rate is generally determined according to a Shannon theorem. The preset ratio may be set according to actual requirements. For example, the preset ratio is set to ¾.

In an implementation, the terminal device may sort the candidate sampling rates in the candidate sampling rate list according to a descending order, so as to sequentially determine, according to the descending order, whether a masking rate of a target frequency band corresponding to a current candidate sampling rate meets the first preset condition. If the current candidate sampling rate meets the first preset condition, the current candidate sampling rate may be used as the first reference sampling rate. If the current candidate sampling rate does not meet the first preset condition, a next candidate sampling rate ranked after the current candidate sampling rate is used as a new current candidate sampling rate, to continuously determine whether the new current candidate sampling rate meets the first preset condition until a candidate sampling rate meeting the first preset condition is determined. When no candidate sampling rate meets the first preset condition, a minimum candidate sampling rate in the candidate sampling rate list is used as the first reference sampling rate.

To help understand the foregoing process of determining the first reference sampling rate, the process of determining the first reference sampling rate is exemplarily described below.

Assuming that the candidate sampling rate list includes the following candidate sampling rates sorted according to a descending order: 96 khz, 48 khz, 32 khz, 16 khz and 8 khz, the terminal device performs determining in descending order starting from 96 khz, that is, 96 khz is first used as the current candidate sampling rate. According to a requirement of the Shannon theorem, the sampling rate is at least twice of the highest frequency, and it may be determined that a highest frequency corresponding to the candidate sampling rate 96 khz is 48 khz. Assuming that the preset ratio is ¾, and the second preset threshold is 0.8, in this case, the terminal device needs to further determine whether a masking rate of a frequency band above ¾ of 48 khz is greater than 0.8. If so, 96 khz may be directly determined as the first reference sampling rate without determining subsequent other candidate sampling rates. If not, 96 khz may not be used as the first reference sampling rate, and 48 khz needs to be further used as the current candidate sampling rate. The foregoing determination process is performed for 48 khz, and the rest is deduced by analogy until a candidate sampling rate with a masking rate of a frequency band above ¾ of the highest frequency being greater than 0.8 is selected from the candidate sampling rate list. If none of the candidate sampling rates in the candidate sampling rate list meets the foregoing condition, that is, the first preset condition, the minimum candidate sampling rate in the candidate sampling rate list is used as the first reference sampling rate.

The masking rate of the target frequency band corresponding to the candidate sampling rate may be specifically obtained through calculation based on Formula (22):

$$\text{Ratio}_{mask}=(\Sigma_{k=K1}^{K2}\text{flag}(k))/(K2-K1+1) \quad (2)$$

where $\text{Ratio}_{mask}$ is the masking rate of the target frequency band corresponding to the candidate sampling rate, K1 is the target frequency corresponding to the candidate sampling rate, and K2 is the highest frequency corresponding to the candidate sampling rate.

In actual application, the candidate sampling rates included in the candidate sampling rate list may be set according to actual requirements. The candidate sampling rates included in the candidate sampling rate list are not limited herein. The second preset threshold may alternatively be set according to actual requirements. The second preset threshold is not limited herein either.

Step 302. Configure an encoding sampling rate of an audio encoder based on the first reference sampling rate.

After determining the first reference sampling rate, the terminal device further configures the encoding sampling rate of the audio encoder of the terminal device based on the first reference sampling rate, so that the terminal device encodes, based on the encoding sampling rate, the audio signal transmitted to the receiving end.

In an implementation, the terminal device may directly configure the first reference sampling rate determined in step 301 as the encoding sampling rate of the audio encoder.

In another implementation, to ensure that the encoded audio signal is not masked by the background environmental noise of the receiving end and has better sound quality, the terminal device may determine the encoding sampling rate of the audio encoder by combining the first reference sampling rate and a second reference sampling rate determined according to a terminal processing capability. For example, the terminal device may obtain the second reference sampling rate, the second reference sampling rate being determined according to the terminal processing capability; and further select a minimum value between the first reference sampling rate and the second reference sampling rate, and assign a value to the encoding sampling rate of the audio encoder.

During implementation, the terminal device may determine the second reference sampling rate based on a relevant sampling rate determining manner and according to features of the audio signal to be transmitted and the processing capacity of the terminal device, and encode, based on the second reference sampling rate, the audio signal to be transmitted, to obtain the audio signal with better sound quality. Further, the terminal device selects the minimum value from the second reference sampling rate and the first reference sampling rate determined in step 301 as the encoding sampling rate assigned to the audio encoder.

In this way, the audio signal to be transmitted by the transmitting end is encoded based on the minimum value between the first reference sampling rate and the second reference sampling rate, to ensure that the audio signal transmitted to the receiving end is not masked by the background environmental noise of the receiving end and has better sound quality.

After completing the configuration of the encoding sampling rate, the terminal device may further configure the encoding bit rate of the audio encoder based on the first reference bit rate determined in the embodiment shown in FIG. 2 and a third reference bit rate matching the encoding sampling rate. Under different network bandwidth conditions, the encoding sampling rate corresponds to different reference bit rates. The terminal device may use a bit rate corresponding to an encoding sampling rate under a current network bandwidth condition as the third reference bit rate, and then select a smaller bit rate from the first reference bit rate and the second reference bit rate, to be assigned to the audio encoder.

In the foregoing encoding sampling rate adjustment method, from the perspective of optimal coordination of end-to-end effects, considering the influence of an auditory acoustic environment in which the receiving end is actually located on the audio signal transmitted by the transmitting end, end-to-end closed-loop feedback adjustment on the encoding parameters of the audio signal is implemented, thereby effectively improving encoding quality conversion efficiency of the audio signal and ensuring a better voice call effect between the transmitting end and the receiving end.

To help further understand the encoding parameter adjustment method provided in the embodiments of this application, the following still uses an example in which an execution entity is a terminal device serving as a transmitting end, to provide an overall description on the encoding parameter adjustment method shown in FIG. 2 and FIG. 3 with reference to an application scenario of a real-time voice call.

Figure 4A:
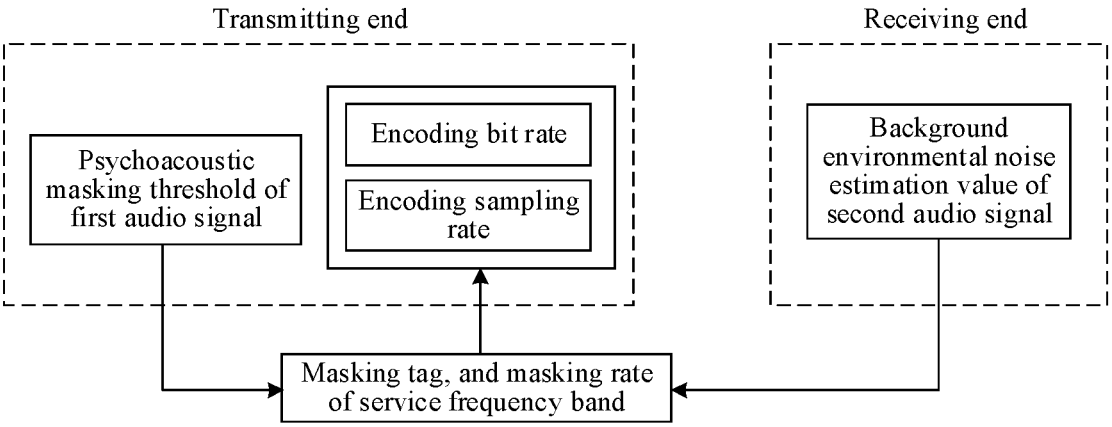
FIG. 4*a* is a schematic flowchart of an overall principle of an encoding sampling rate adjustment method according to an embodiment of this application.

FIG. 4*a* is a schematic flowchart of an overall principle of an encoding parameter adjustment method according to an embodiment of this application.

As shown in FIG. 4*a*, during a real-time voice call, the terminal device serving as the transmitting end obtains a first audio signal recorded by a microphone of the terminal device, the first audio signal being an audio signal that needs to be transmitted to a receiving end by the transmitting end, and calculates a psychoacoustic masking threshold of each frequency within a service frequency band in the first audio signal by using a method for calculating a psychoacoustic masking threshold in the related art.

In addition, the terminal device serving as the transmitting end further needs to obtain, from a corresponding receiving end, a background environmental noise estimation value of the frequency within the service frequency band in a second audio signal recorded by the receiving end. The second audio signal can reflect an auditory acoustic environment in which the receiving end is located during the real-time voice call. The receiving end may specifically calculate the background environmental noise estimation value of the frequency within the service frequency band in the second audio signal by using a noise estimation method such as an MCRA algorithm. In actual application, the receiving end may alternatively directly transmit the second audio signal recorded by the receiving end to the transmitting end, and the transmitting end calculates the background environmental noise estimation value of the frequency within the service frequency band in the second audio signal.

Further, the terminal device serving as the transmitting end may determine a masking tag corresponding to the frequency within the service frequency band according to the psychoacoustic masking threshold of the frequency within the service frequency band in the first audio signal and the background environmental noise estimation value of the frequency within the service frequency band in the second audio signal. When the psychoacoustic masking threshold at the frequency is far less than the background environmental noise estimation value, it may be considered that the audio signal recorded by the transmitting end has a low voice audible probability at the frequency and is likely to be masked by the background environmental noise of the receiving end. A corresponding masking tag may be set to 1 for a frequency to be masked, and a corresponding masking tag may be set to 0 for a frequency not to be masked.

A masking rate of the service frequency band is determined according to the masking tag corresponding to the frequency within the service frequency band. When the masking rate of the service frequency band is greater than or equal to a first preset threshold, it indicates that the background environmental noise of the receiving end has a relatively strong masking effect on the audio signal transmitted by the transmitting end. In this case, there is little significance to perform high-quality encoding by using a high bit rate, and therefore, an encoding bit rate that is acceptable in quality and relatively low in value may be correspondingly selected. That is, a smaller preset second available bit rate is selected as the first reference bit rate; otherwise, when the masking rate of the service frequency band is less than the first preset threshold, it indicates that the background environmental noise of the receiving end basically does not generate the masking effect on the audio signal transmitted by the transmitting end. In this case, an encoding bit rate with a larger value may be correspondingly selected. That is, a larger preset first available bit rate is selected as the first reference bit rate.

Finally, the terminal device may select a minimum value from the first reference bit rate and the second reference bit rate that is determined according to a network bandwidth as an encoding bit rate used when the audio encoder performs audio encoding. When the background environmental noise of the receiving end generates the relatively strong masking effect on the audio signal transmitted by the transmitting end, in this case, the terminal device may select a smaller encoding bit rate for audio encoding, thereby saving the network bandwidth, and the saved network bandwidth is used for redundant channel encoding of a forward error correction (FEC) technology, thereby improving the network anti-packet loss capability and ensuring the continuous intelligibility of the audio signal of the receiving end.

In addition, before configuring the encoding bit rate, the terminal device may further select a maximum candidate sampling rate meeting a first preset condition from a candidate sampling rate list. That is, the terminal device may further calculate a masking rate of a target frequency band corresponding to each candidate sampling rate in the candidate sampling rate list, and select, from candidate sampling rates with the masking rate of the target frequency band being greater than a second preset threshold, a maximum candidate sampling rate as a first reference sampling rate; and further select a minimum value from the first reference sampling rate and a second reference sampling rate determined according to a processing capacity of the terminal device as an encoding sampling rate used when the audio encoder performs audio encoding. Correspondingly, when configuring the encoding bit rate, the terminal device may select a smaller value from the first reference bit rate and the second reference bit rate matching the encoding sampling rate as a final encoding bit rate to be assigned to the audio encoder.

Figure 4B:
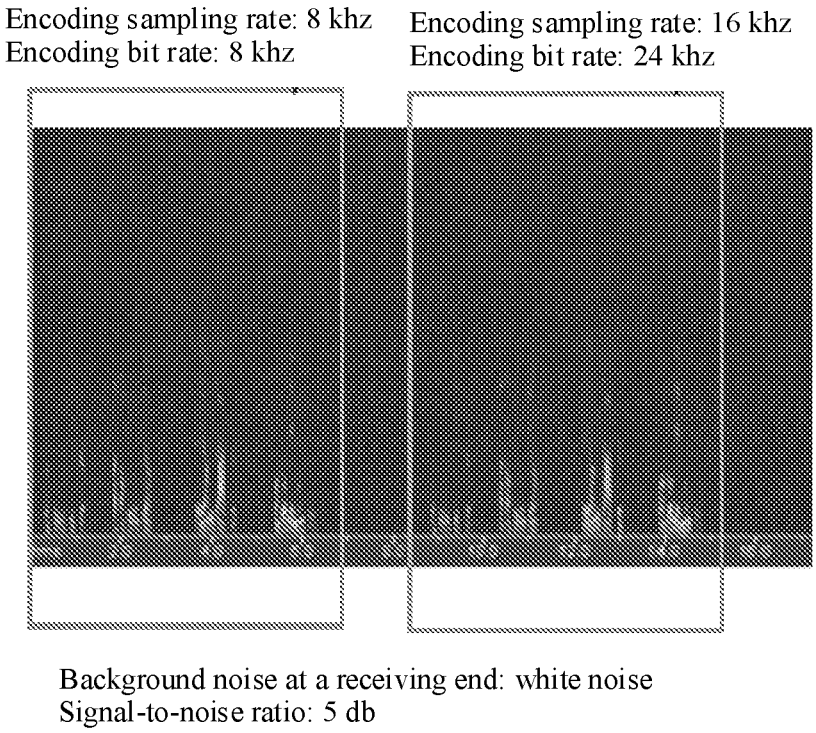
FIG. 4*b* is a diagram of comparison between effects of an encoding parameter adjustment method in the related art and an encoding parameter adjustment method according to an embodiment of this application.

Upon experimental verification, in a scenario in which the background environmental noise of the receiving end is relatively large, for example, in a scenario in which white noise exists and a signal-to-noise ratio is 5 db, a silk encoder (which is an audio wideband encoder) is used as an example. By using the solution in the related art, generally, the encoding bit rate of the audio signal is set to 24 kbps, and the encoding sampling rate is set to 16 khz, as shown in the right part in FIG. 4*b*. By using the encoding parameter adjustment method provided in the embodiments of this application, the background environmental noise estimation value in the second audio signal recorded by the receiving end is combined with the psychoacoustic masking threshold in the first audio signal recorded by the transmitting end, the finally determined encoding bit rate is 8 kpbs, and the encoding sampling rate is 8 khz, as shown in the left in FIG. 4*b*.

From the perspective of subjective actual measurement at the receiving end, the audio signal encoded based on the encoding bit rate and the encoding sampling rate that are determined in the related art, and the audio signal encoded based on the encoding bit rate and the encoding sampling rate that are determined in the technical solution provided in the embodiments of this application have almost the same audio signal effect at the receiving end, and there is no obvious difference. However, because the encoding bit rate determined based on the technical solution provided in the embodiments of this application is one third of that in the related art, an overall bandwidth occupied during transmission by the audio signal obtained through encoding using the encoding parameters determined based on the technical solution provided in the embodiments of this application is only one third of that in the related art, thereby greatly saving the encoding bandwidth and truly improving the encoding conversion efficiency.

For the encoding parameter adjustment method described above, this application further provides a corresponding encoding parameter adjustment apparatus, so that the encoding parameter adjustment method is applicable and implemented in practice.

Figure 5:
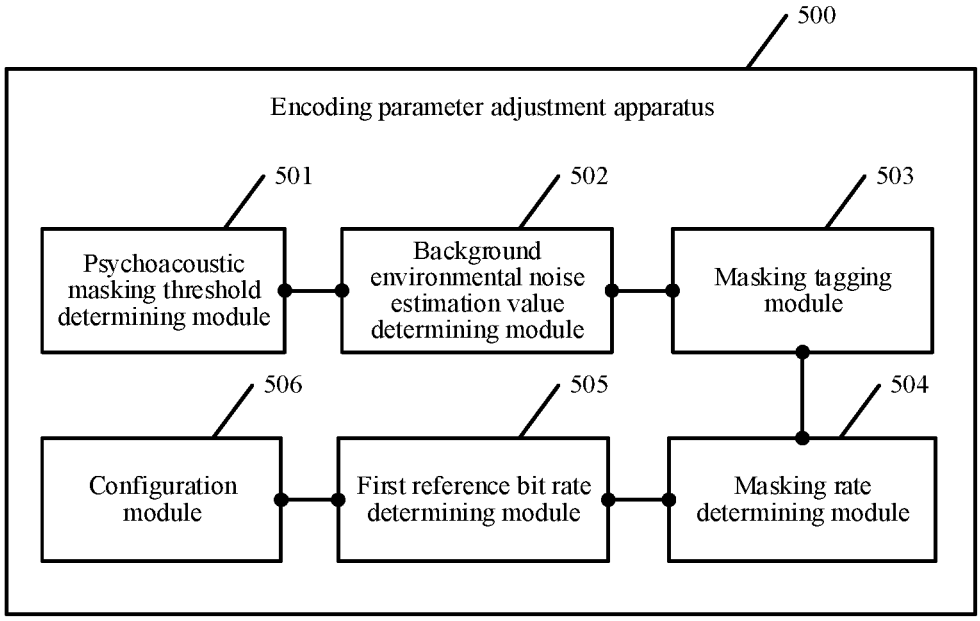
FIG. 5 is a schematic structural diagram of an encoding parameter adjustment apparatus according to an embodiment of this application.

FIG. 5 is a schematic structural diagram of an encoding parameter adjustment apparatus 500 corresponding to the foregoing encoding parameter adjustment method shown in FIG. 2. The encoding parameter adjustment apparatus 500 includes:

a psychoacoustic masking threshold determining module 501, configured to obtain a first audio signal recorded by a transmitting end, and determine a psychoacoustic masking threshold of each frequency within a service frequency band designated by a target service in the first audio signal;

a background environmental noise estimation value determining module 502, configured to obtain a second audio signal recorded by a receiving end, and determine a background environmental noise estimation value of the frequency within the service frequency band in the second audio signal;

a masking tagging module 503, configured to determine a masking tag corresponding to the frequency according to the psychoacoustic masking threshold of the frequency within the service frequency band in the first audio signal and the background environmental noise estimation value of the frequency within the service frequency band in the second audio signal;

a masking rate determining module 504, configured to determine a masking rate of the service frequency band according to the masking tag corresponding to the frequency within the service frequency band;

a first reference bit rate determining module 505, configured to determine a first reference bit rate according to the masking rate of the service frequency band; and a configuration module 506, configured to configure an encoding bit rate of an audio encoder based on the first reference bit rate.

In some embodiments, based on the encoding parameter adjustment apparatus shown in FIG. 5, the first reference bit rate determining module 505 is specifically configured to:

use a preset first available bit rate as the first reference bit rate in a case that the masking rate of the service frequency band is less than a first preset threshold; and use a preset second available bit rate as the first reference bit rate in a case that the masking rate of the service frequency band is not less than the first preset threshold, the preset second available bit rate being less than the preset first available bit rate.

In some embodiments, based on the encoding parameter adjustment apparatus shown in FIG. 5, the first reference bit rate determining module 505 is specifically configured to:

match the masking rate of the service frequency band with a plurality of preset adjacent threshold intervals, and determine an adjacent threshold interval matching the masking rate of the service frequency band as a target threshold interval, different adjacent threshold intervals being corresponding to different reference bit rates; and use a reference bit rate corresponding to the target threshold interval as the first reference bit rate.

In some embodiments, based on the encoding parameter adjustment apparatus shown in FIG. 5, the configuration module 506 is specifically configured to:

obtain a second reference bit rate, the second reference bit rate being determined according to a network bandwidth; and assign a value to the encoding bit rate of the audio encoder based on a minimum value between the first reference bit rate and the second reference bit rate.

Figure 6:
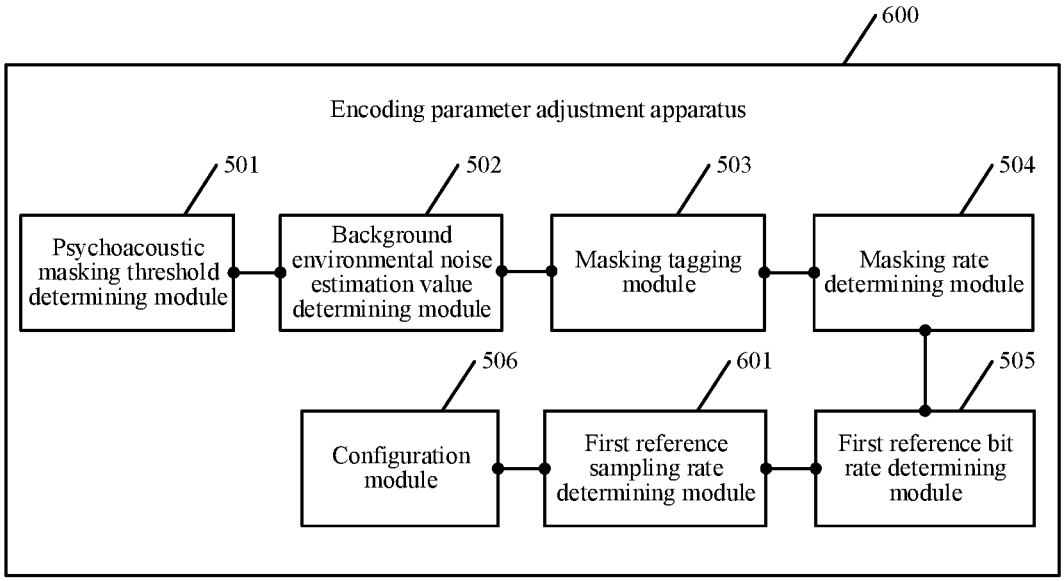
FIG. 6 is a schematic structural diagram of another encoding parameter adjustment apparatus according to an embodiment of this application.

In some embodiments, based on the encoding parameter adjustment apparatus 500 shown in FIG. 5, FIG. 6 is a schematic structural diagram of another encoding parameter adjustment apparatus according to an embodiment of this application. As shown in FIG. 6, the encoding parameter adjustment apparatus 600 further includes:

a first reference sampling rate determining module 601, configured to select a maximum candidate sampling rate meeting a first preset condition from a candidate sampling rate list as a first reference sampling rate, the first preset condition being that a masking rate of a target frequency band corresponding to a candidate sampling rate is greater than a second preset threshold, the target frequency band of the candidate sampling rate referring to a frequency region above a target frequency corresponding to the candidate sampling rate, the target frequency corresponding to the candidate sampling rate being determined according to a highest frequency corresponding to the candidate sampling rate and a preset ratio, the configuration module 506 being further configured to configure an encoding sampling rate of an audio encoder based on the first reference sampling rate, and when configuring an encoding bit rate of the audio encoder, being specifically configured to:

configure the encoding bit rate of the audio encoder based on the first reference bit rate and a third reference bit rate matching the encoding sampling rate.

In some embodiments, based on the encoding parameter adjustment apparatus shown in FIG. 6, the first reference sampling rate determining module 601 is specifically configured to:

sequentially determine, according to a descending order of the candidate sampling rates in the candidate sampling rate list, whether a masking rate of a target frequency band corresponding to a current candidate sampling rate meets the first preset condition;

use the current candidate sampling rate as the first reference sampling rate in a case that the current candidate sampling rate meets the first preset condition; and determine, according to the descending order of the candidate sampling rate list in a case that the current candidate sampling rate does not meet the first preset condition, whether a next candidate sampling rate of the current candidate sampling rate meets the first preset condition.

In some embodiments, based on the encoding parameter adjustment apparatus shown in FIG. 6, the configuration module 506 is specifically configured to:

obtain a second reference sampling rate, the second reference sampling rate being determined according to a processing capacity of a terminal device; and assign a value to the encoding sampling rate of the audio encoder based on a minimum value between the first reference sampling rate and the second reference sampling rate.

In some embodiments, based on the encoding parameter adjustment apparatus shown in FIG. 5, the background environmental noise estimation value determining module 502 is specifically configured to:

determine a power spectrum of the second audio signal;

perform time-frequency domain smoothing processing on the power spectrum of the second audio signal;

determine a minimum value of a voice with noise as a rough estimation of the noise based on the power spectrum after the time-frequency domain smoothing processing and by using a minimum tracking method;

determine a voice existence probability according to the rough estimation of the noise and the power spectrum after the time-frequency domain smoothing processing; and determine the background environmental noise estimation value of the frequency within the service frequency band in the second audio signal according to the voice existence probability.

In this application, the term "unit" or "module" refers to a computer program or part of the computer program that has a predefined function and works together with other related parts to achieve a predefined goal and may be all or partially implemented by using software, hardware (e.g., processing circuitry and/or memory configured to perform the predefined functions), or a combination thereof. Each unit or module can be implemented using one or more processors (or processors and memory). Likewise, a processor (or processors and memory) can be used to implement one or more modules or units. Moreover, each module or unit can be part of an overall module that includes the functionalities of the module or unit. In the foregoing encoding parameter adjustment apparatus, from the perspective of optimal coordination of end-to-end effects, considering the influence of an auditory acoustic environment in which the receiving end is actually located on the audio signal transmitted by the transmitting end, end-to-end closed-loop feedback adjustment on the encoding parameters of the audio signal is implemented based on the background environmental noise estimation value fed back by a receiver, thereby effectively improving encoding quality conversion efficiency of the audio signal and ensuring a better voice call effect between the transmitting end and the receiving end.

Embodiments of this application further provide a terminal device and a server configured to adjust encoding parameters. The terminal device and the server configured to adjust encoding parameters provided in the embodiments of this application is described below from the perspective of hardware substantiation.

Figure 7:
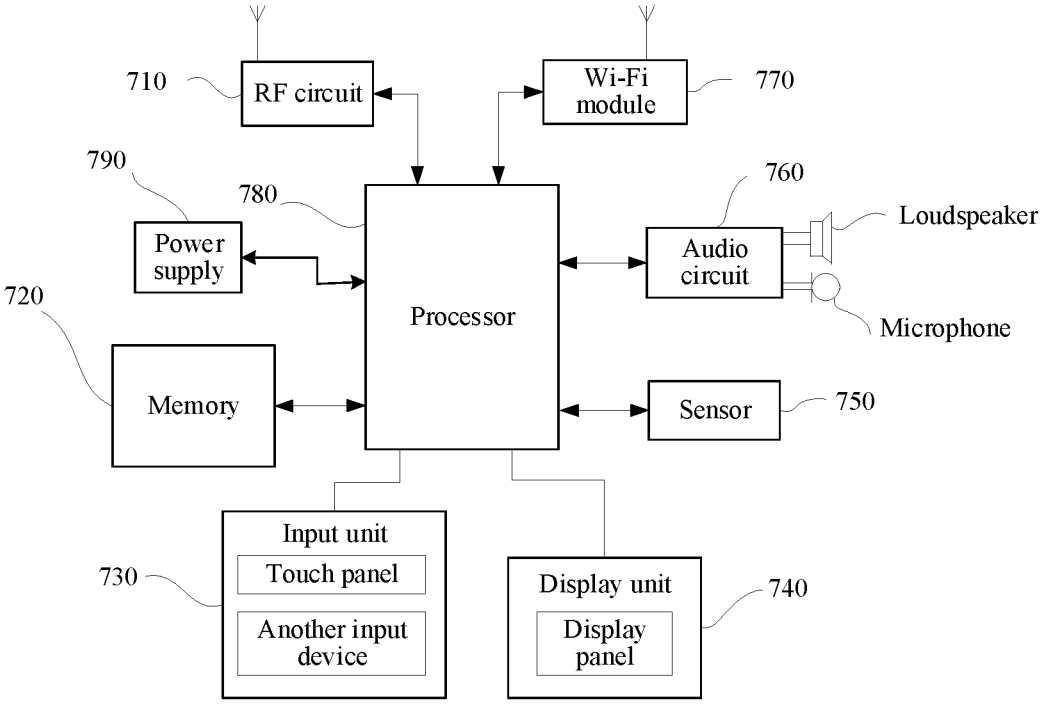
FIG. 7 is a schematic structural diagram of a terminal device according to an embodiment of this application.

FIG. 7 is a schematic structural diagram of a terminal device according to an embodiment of this application. For ease of description, only a part related to this embodiment of this application is shown. For a specific technical detail not disclosed, refer to the method part in the embodiments of this application. The terminal may be any terminal device including a mobile phone, a tablet computer, a PDA, a point of sales (POS), a vehicle-mounted computer, or the like. For example, the terminal is a mobile phone.

FIG. 7 is a block diagram of a part of a structure of a mobile phone related to a terminal according to an embodiment of this application. Referring to FIG. 7, the mobile phone includes components such as a radio frequency (RF) circuit 710, a memory 720, an input unit 730, a display unit 740, a sensor 750, an audio circuit 760, a wireless fidelity (Wi-Fi) module 770, a processor 780, and a power supply 790. A person skilled in the art may understand that the structure of the mobile phone shown in FIG. 7 does not constitute a limitation on the mobile phone, and the mobile phone may include more or fewer components than those shown in the figure, or some components may be combined, or a different component deployment may be used.

The memory 720 may be configured to store a software program and a module. The processor 780 runs the software program and the module that are stored in the memory 720, to perform various functional applications and data processing of the mobile phone. The memory 720 may mainly include a program storage area and a data storage area. The program storage area may store an operating system, an application program required by at least one function (such as a sound playback function and an image display function), and the like. The data storage area may store data (such as audio data and an address book) created according to the use of the mobile phone, and the like. In addition, the memory 720 may include a high-speed random access memory, and may also include a nonvolatile memory, for example, at least one magnetic disk storage device, a flash memory, or another volatile solid-state storage device.

The processor 780 is the control center of the mobile phone, and is connected to various parts of the entire mobile phone by using various interfaces and lines. By running or executing the software program and/or the module stored in the memory 720, and invoking data stored in the memory 720, the processor performs various functions and data processing of the mobile phone, thereby performing overall monitoring on the mobile phone. In some embodiments, the processor 780 may include one or more processing units. Preferably, the processor 780 may integrate an application processor and a modem. The application processor mainly processes an operating system, a user interface, an application program, and the like. The modem mainly processes wireless communication. The modem may either not be integrated into the processor 780.

In this embodiment of this application, the processor 780 included in the terminal further has the following functions:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate.

In some embodiments, the processor 780 is further configured to perform the steps in any implementation of the encoding parameter adjustment method provided in the embodiments of this application.

Figure 8:
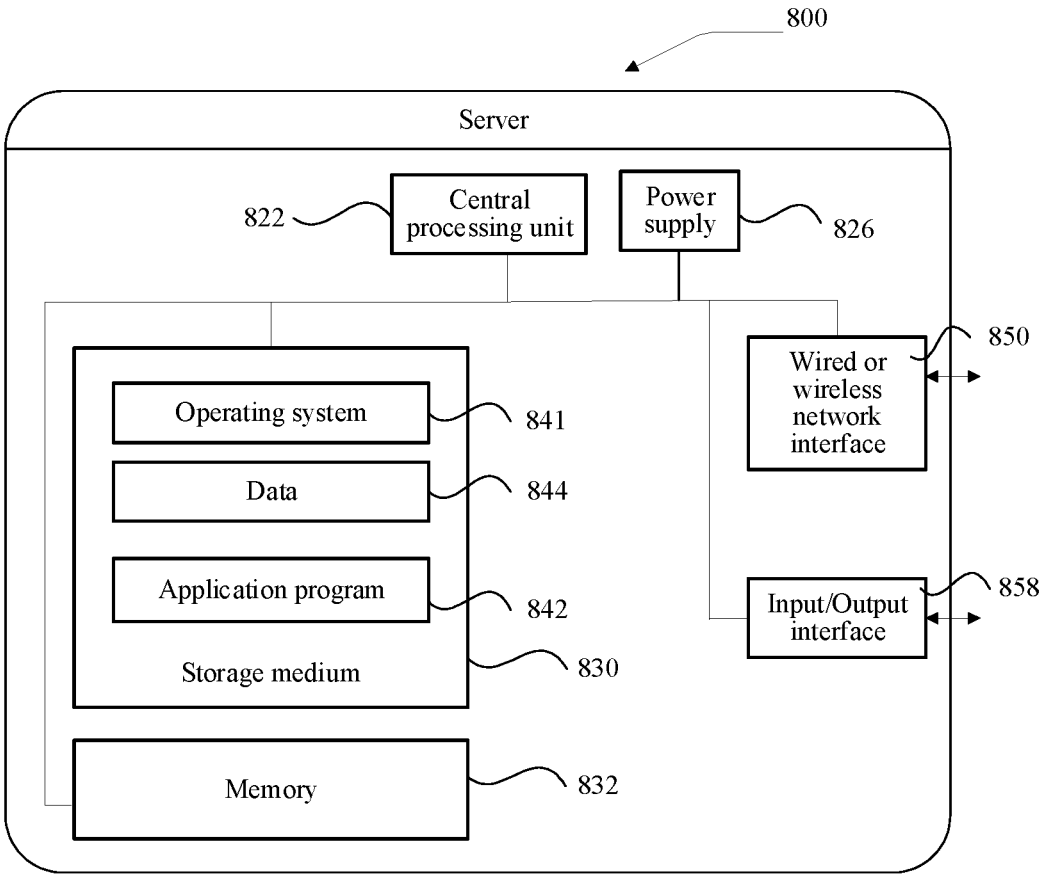
FIG. 8 is a schematic structural diagram of a server according to an embodiment of this application.

Embodiments of this application further provide a server. FIG. 8 is a schematic structural diagram of a server according to an embodiment of this application. The server 800 may vary greatly due to different configurations or performance, and may include one or more central processing units (CPU) 822 (for example, one or more processors) and a memory 832, and one or more storage media 830 (for example, one or more mass storage devices) that store application programs 842 or data 844. The memory 832 and the storage medium 830 may implement transient storage or permanent storage. A program stored in the storage medium 830 may include one or more modules (not shown in the figure), and each module may include a series of instruction operations on the server. Furthermore, the CPU 822 may be configured to communicate with the storage medium 830, and perform, on the server 800, the series of instruction operations in the storage medium 830.

The server 800 may further include one or more power supplies 826, one or more wired or wireless network interfaces 850, one or more input/output interfaces 858, and/or one or more operating systems 841 such as Windows Server™, Mac OS X™, Unix™, Linux™, and FreeBSD™.

The steps performed by the server in the foregoing embodiments may be based on the server structure shown in FIG. 8.

The CPU 822 is configured to perform the following steps:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate.

In some embodiments, the CPU 822 may be further configured to perform the steps in any implementation of the encoding parameter adjustment method according to the embodiments of this application.

Embodiments of this application further provide a computer-readable storage medium, configured to store a computer program, the computer program being configured to perform any implementation in the encoding parameter adjustment method according to the foregoing embodiments.

Embodiments of this application further provide a computer program product including instructions, the instructions, when run on a computer, causing the computer to perform any implementation in the encoding parameter adjustment method according to the foregoing embodiments.

A person skilled in the art can clearly understand that for convenience and conciseness of description, for specific working processes of the foregoing described system, apparatus and unit, refer to the corresponding processes in the foregoing method embodiments, and details are not described herein again.

In the several embodiments provided in this application, the disclosed system, apparatus, and method may be implemented in other manners. For example, the described apparatus embodiment is merely exemplary. For example, the unit division is merely a logical function division and may be other division during actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate components may or may not be physically separated, and the components displayed as units may or may not be physical units, and may be located in one place or may be distributed over a plurality of network units. Some or all of the units may be selected according to actual requirements to achieve the objectives of the solutions of the embodiments.

In addition, functional units in the embodiments of this application may be integrated into one processing unit, or each of the units may exist alone physically, or two or more units may be integrated into one unit. The integrated unit may be implemented in a form of hardware, or may be implemented in a form of a software functional unit.

When the integrated unit is implemented in the form of a software functional unit and sold or used as an independent product, the integrated unit may be stored in a computer-readable storage medium. Based on such an understanding, the technical solution of this application essentially, or the part contributing to the related technology, or all or some of the technical solution may be implemented in the form of a software product. The computer software product is stored in a storage medium and includes several instructions for instructing a computer device (which may be a personal computer, a server, a network device, or the like) to perform all or some of the steps of the methods described in the embodiments of this application. The foregoing storage medium includes: any medium that can store a computer program, such as a USB flash drive, a removable hard disk, a read-only memory (ROM), a random access memory (RAM), a magnetic disk, or an optical disk.

The foregoing embodiments are merely intended for describing the technical solution of this application, but not for limiting this application. Although this application is described in detail with reference to the foregoing embodiments, persons of ordinary skill in the art understand that they may still make modifications to the technical solution described in the foregoing embodiments or make equivalent replacements to some technical features thereof, without departing from the spirit and scope of the technical solution of the embodiments of this application.

What is claimed is:

1. An encoding parameter adjustment method performed at a computer device, the encoding parameter adjustment method comprising:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate;

wherein determining the masking tag comprises:

determining the masking tag for low-quality encoding for the first audio signal recorded by the transmitting end that has a high probability to be masked by a background environmental noise of the receiving end when a ratio of the background environmental noise estimation value and the psychoacoustic masking threshold of the frequency is greater than a predetermined value; and determining the masking tag for high-quality encoding for the first audio signal recorded by the transmitting end that has a low probability to be masked by the background environmental noise of the receiving end when the ratio of the background environmental noise estimation value and the psychoacoustic masking threshold of the frequency is less than or equal to the predetermined value; and wherein the determining the background environmental noise estimation value of the receiving end is performed at the transmitting end.

2. The encoding parameter adjustment method according to claim 1, wherein the determining a first reference bit rate according to the masking rate of the service frequency band comprises:

using a preset first available bit rate as the first reference bit rate in a case that the masking rate of the service frequency band is less than a first preset threshold; and using a preset second available bit rate as the first reference bit rate in a case that the masking rate of the service frequency band is not less than the first preset threshold, the preset second available bit rate being less than the preset first available bit rate.

3. The encoding parameter adjustment method according to claim 1, wherein the determining a first reference bit rate according to the masking rate of the service frequency band comprises:

matching the masking rate of the service frequency band with a plurality of preset adjacent threshold intervals, and determining a threshold interval matching the masking rate of the service frequency band as a target threshold interval, different adjacent threshold intervals being corresponding to different reference bit rates; and using a reference bit rate corresponding to the target threshold interval as the first reference bit rate.

4. The encoding parameter adjustment method according to claim 1, wherein the configuring an encoding bit rate of an audio encoder based on the first reference bit rate comprises:

obtaining a second reference bit rate, the second reference bit rate being determined according to a network bandwidth; and assigning a value to the encoding bit rate of the audio encoder based on a minimum value between the first reference bit rate and the second reference bit rate.

5. The encoding parameter adjustment method according to claim 1, wherein before the configuring an encoding bit rate of an audio encoder based on the first reference bit rate, the encoding parameter adjustment method further comprises:

selecting a maximum candidate sampling rate meeting a first preset condition from a candidate sampling rate list as a first reference sampling rate, the first preset condition being that a masking rate of a target frequency band corresponding to a candidate sampling rate is greater than a second preset threshold, the target frequency band of the candidate sampling rate referring to a frequency region above a target frequency corresponding to the candidate sampling rate, the target frequency corresponding to the candidate sampling rate being determined according to a highest frequency corresponding to the candidate sampling rate and a preset ratio; and configuring an encoding sampling rate of the audio encoder based on the first reference sampling rate; and the configuring an encoding bit rate of an audio encoder based on the first reference bit rate comprises:

configuring the encoding bit rate of the audio encoder based on the first reference bit rate and a third reference bit rate matching the encoding sampling rate.

6. The encoding parameter adjustment method according to claim 5, wherein the selecting a maximum candidate sampling rate meeting a first preset condition from a candidate sampling rate list comprises:

sequentially determining, according to a descending order of the candidate sampling rates in the candidate sampling rate list, whether a masking rate of a target frequency band corresponding to a current candidate sampling rate meets the first preset condition;

using the current candidate sampling rate as the first reference sampling rate in a case that the current candidate sampling rate meets the first preset condition; and determining, according to the descending order of the candidate sampling rate list in a case that the current candidate sampling rate does not meet the first preset condition, whether a next candidate sampling rate of the current candidate sampling rate meets the first preset condition.

7. The encoding parameter adjustment method according to claim 5, wherein the configuring an encoding sampling rate of the audio encoder based on the first reference sampling rate comprises:

obtaining a second reference sampling rate, the second reference sampling rate being determined according to a processing capacity of a terminal device; and assigning a value to the encoding sampling rate of the audio encoder based on a minimum value between the first reference sampling rate and the second reference sampling rate.

8. The encoding parameter adjustment method according to claim 1, wherein the determining, for a second audio signal received by the receiving end, a background environmental noise estimation value of the frequency within the service frequency band in the second audio signal comprises:

determining a power spectrum of the second audio signal;

performing time-frequency domain smoothing processing on the power spectrum of the second audio signal;

determining a minimum value of a voice with noise as a rough estimation of the noise based on the power spectrum after the time-frequency domain smoothing processing and by using a minimum tracking method;

determining a voice existence probability according to the rough estimation of the noise and the power spectrum after the time-frequency domain smoothing processing; and determining the background environmental noise estimation value of the frequency within the service frequency band in the second audio signal according to the voice existence probability.

9. A computer device, comprising a processor and a memory;

the memory being configured to store a plurality of computer programs; and the processor, when executing the plurality of computer programs, being configured to perform a plurality of operations including:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate;

wherein determining the masking tag comprises:

determining the masking tag for low-quality encoding for the first audio signal recorded by the transmitting end that has a high probability to be masked by a background environmental noise of the receiving end when a ratio of the background environmental noise estimation value and the psychoacoustic masking threshold of the frequency is greater than a predetermined value; and determining the masking tag for high-quality encoding for first the audio signal recorded by the transmitting end that has a low probability to be masked by the background environmental noise of the receiving end when the ratio of the background environmental noise estimation value and the psychoacoustic masking threshold of the frequency is less than or equal to the predetermined value; and wherein the determining the background environmental noise estimation value of the receiving end is performed at the transmitting end.

10. The computer device according to claim 9, wherein the determining a first reference bit rate according to the masking rate of the service frequency band comprises:

using a preset first available bit rate as the first reference bit rate in a case that the masking rate of the service frequency band is less than a first preset threshold; and using a preset second available bit rate as the first reference bit rate in a case that the masking rate of the service frequency band is not less than the first preset threshold, the preset second available bit rate being less than the preset first available bit rate.

11. The computer device according to claim 9, wherein the determining a first reference bit rate according to the masking rate of the service frequency band comprises:

matching the masking rate of the service frequency band with a plurality of preset adjacent threshold intervals, and determining a threshold interval matching the masking rate of the service frequency band as a target threshold interval, different adjacent threshold intervals being corresponding to different reference bit rates; and using a reference bit rate corresponding to the target threshold interval as the first reference bit rate.

12. The computer device according to claim 9, wherein the configuring an encoding bit rate of an audio encoder based on the first reference bit rate comprises:

obtaining a second reference bit rate, the second reference bit rate being determined according to a network bandwidth; and assigning a value to the encoding bit rate of the audio encoder based on a minimum value between the first reference bit rate and the second reference bit rate.

13. The computer device according to claim 9, wherein before the configuring an encoding bit rate of an audio encoder based on the first reference bit rate, the plurality of operations further comprise:

selecting a maximum candidate sampling rate meeting a first preset condition from a candidate sampling rate list as a first reference sampling rate, the first preset condition being that a masking rate of a target frequency band corresponding to a candidate sampling rate is greater than a second preset threshold, the target frequency band of the candidate sampling rate referring to a frequency region above a target frequency corresponding to the candidate sampling rate, the target frequency corresponding to the candidate sampling rate being determined according to a highest frequency corresponding to the candidate sampling rate and a preset ratio; and configuring an encoding sampling rate of the audio encoder based on the first reference sampling rate; and the configuring an encoding bit rate of an audio encoder based on the first reference bit rate comprises:

configuring the encoding bit rate of the audio encoder based on the first reference bit rate and a third reference bit rate matching the encoding sampling rate.

14. The computer device according to claim 13, wherein the selecting a maximum candidate sampling rate meeting a first preset condition from a candidate sampling rate list comprises:

sequentially determining, according to a descending order of the candidate sampling rates in the candidate sampling rate list, whether a masking rate of a target frequency band corresponding to a current candidate sampling rate meets the first preset condition;

using the current candidate sampling rate as the first reference sampling rate in a case that the current candidate sampling rate meets the first preset condition; and determining, according to the descending order of the candidate sampling rate list in a case that the current candidate sampling rate does not meet the first preset condition, whether a next candidate sampling rate of the current candidate sampling rate meets the first preset condition.

15. The computer device according to claim 13, wherein the configuring an encoding sampling rate of the audio encoder based on the first reference sampling rate comprises:

obtaining a second reference sampling rate, the second reference sampling rate being determined according to a processing capacity of a terminal device; and assigning a value to the encoding sampling rate of the audio encoder based on a minimum value between the first reference sampling rate and the second reference sampling rate.

16. The computer device according to claim 9, wherein the determining, for a second audio signal received by the receiving end, a background environmental noise estimation value of the frequency within the service frequency band in the second audio signal comprises:

determining a power spectrum of the second audio signal;

performing time-frequency domain smoothing processing on the power spectrum of the second audio signal;

determining a minimum value of a voice with noise as a rough estimation of the noise based on the power spectrum after the time-frequency domain smoothing processing and by using a minimum tracking method;

determining a voice existence probability according to the rough estimation of the noise and the power spectrum after the time-frequency domain smoothing processing; and determining the background environmental noise estimation value of the frequency within the service frequency band in the second audio signal according to the voice existence probability.

17. A non-transitory computer-readable storage medium, configured to store a plurality of computer programs, the computer programs, when executed by a processor of a computer device, causing the computer device to perform a plurality of operations including:

obtaining a first audio signal recorded by a transmitting end, and determining a psychoacoustic masking threshold of each frequency within a service frequency band designated by a target service in the first audio signal;

obtaining a second audio signal recorded by a receiving end, and determining a background environmental noise estimation value of the frequency within the service frequency band in the second audio signal;

determining a masking tag corresponding to the frequency within the service frequency band according to the psychoacoustic masking threshold of the frequency within the service frequency band in the first audio signal and the background environmental noise estimation value of the frequency within the service frequency band in the second audio signal;

determining a masking rate of the service frequency band according to the masking tag corresponding to the frequency within the service frequency band;

determining a first reference bit rate according to the masking rate of the service frequency band; and configuring an encoding bit rate of an audio encoder based on the first reference bit rate;

wherein determining the masking tag comprises:

determining the masking tag for low-quality encoding for the first audio signal recorded by the transmitting end that has a high probability to be masked by a background environmental noise of the receiving end when a ratio of the background environmental noise estimation value and the psychoacoustic masking threshold of the frequency is greater than a predetermined value; and determining the masking tag for high-quality encoding for the first audio signal recorded by the transmitting end that has a low probability to be masked by the background environmental noise of the receiving end when the ratio of the background environmental noise estimation value and the psychoacoustic masking threshold of the frequency is less than or equal to the predetermined value; and wherein the determining the background environmental noise estimation value of the receiving end is performed at the transmitting end.

18. The non-transitory computer-readable storage medium according to claim 17, wherein the determining a first reference bit rate according to the masking rate of the service frequency band comprises:

using a preset first available bit rate as the first reference bit rate in a case that the masking rate of the service frequency band is less than a first preset threshold; and using a preset second available bit rate as the first reference bit rate in a case that the masking rate of the service frequency band is not less than the first preset threshold, the preset second available bit rate being less than the preset first available bit rate.

19. The non-transitory computer-readable storage medium according to claim 17, wherein the determining a first reference bit rate according to the masking rate of the service frequency band comprises:

matching the masking rate of the service frequency band with a plurality of preset adjacent threshold intervals, and determining a threshold interval matching the masking rate of the service frequency band as a target threshold interval, different adjacent threshold intervals being corresponding to different reference bit rates; and using a reference bit rate corresponding to the target threshold interval as the first reference bit rate.

20. The non-transitory computer-readable storage medium according to claim 17, wherein the configuring an encoding bit rate of an audio encoder based on the first reference bit rate comprises:

obtaining a second reference bit rate, the second reference bit rate being determined according to a network bandwidth; and assigning a value to the encoding bit rate of the audio encoder based on a minimum value between the first reference bit rate and the second reference bit rate.

* * * * *